United States Patent [19]

Lammers et al.

[11] Patent Number: 4,935,672

[45] Date of Patent: Jun. 19, 1990

[54] HIGH FREQUENCY BALLAST FOR A GAS DISCHARGE LAMP

[75] Inventors: Franciscus H. T. Lammers, Eindhoven; Henk Houkes, Oss, both of Netherlands; Paul R. Veldman, Mt. Kisco, N.Y.

[73] Assignee: U.S. Philips Corporation, New York, N.Y.

[21] Appl. No.: 203,050

[22] Filed: Jun. 2, 1988

[30] Foreign Application Priority Data

Jun. 5, 1987 [NL] Netherlands ..... 8701314

[51] Int. Cl.[5] ..... H05B 37/00

[52] U.S. Cl. ..... 315/200 R; 315/226; 315/DIG. 7

[58] Field of Search ..... 315/200 R, 226, 241 R, 315/244, 245, DIG. 7

[56] References Cited

U.S. PATENT DOCUMENTS 4,525,650 6/1985 Hicks et al. ..... 315/DIG. 7 X
4,647,820 3/1987 Chermin et al. ..... 315/244 X
4,677,345 6/1987 Nilssen ..... 315/DIG. 7 X
4,819,146 4/1989 Nilssen ..... 315/DIG. 7 X

*Primary Examiner*—Robert J. Pascal
*Attorney, Agent, or Firm*—Bernard Franzblau

[57] ABSTRACT

A DC-AC converter for igniting and supplying a gas discharge lamp (1). The converter has two input terminals (C, D) to be connected to a DC voltage source. The input terminals are interconnected by means of a series arrangement that includes a load circuit comprising at least the lamp (1) and an induction coil (5), and a first semiconductor switching element (6) including a freewheel diode. The load circuit is bridged by a circuit including a second semiconductor switching element (7) with a freewheel diode. The semiconductor switching elements (6, 7) are provided with control circuits for rendering said switching elements alternately conducting. The control circuit (9) of switching element (7) has a voltage measuring point which is connected via a rectifier element (10) to the control circuit (8) of the first switching element.

14 Claims, 2 Drawing Sheets

HIGH FREQUENCY BALLAST FOR A GAS DISCHARGE LAMP

BACKGROUND OF THE INVENTION

The invention relates to an electronic ballast including a DC-AC converter for igniting and supplying a gas discharge lamp, and in particular to such a converter having two input terminals to be connected to a DC voltage source. The input terminals are interconnected by means of a series arrangement which includes a load circuit comprising at least the discharge lamp and an induction coil, and a first semiconductor switching element including a freewheel diode. The load circuit is bridged by a circuit including a second semiconductor switching element and also having a freewheel diode, the semiconductor switching elements being provided with control circuits for rendering said switching elements alternately conductive. A converter of this type is known from U.S. Pat. No. 4,647,820.

The above-mentioned semiconductor switching elements are rendered conducting and non-conducting by means of their respective control electrodes. The freewheel function can be provided using a type of semiconductor element having an integral diode element or using a separate diode element arranged in parallel therewith.

The aforesaid Patent describes a half bridge converter with a transformer which is present in the load circuit (in which the lamp is incorporated). This transformer has two secondary windings which form part of the control circuits of the semiconductor switching elements. The switching elements are rendered alternately conducting and non-conducting by means of the transformer and the control circuits, respectively. It has been found that it is difficult to adjust the oscillation frequency of the system in a reproducible manner to a fixed value due to the use of a transformer. This is a drawback, notably when the system is used in lamps which are manufactured in a bulk manufacturing process. Moreover, the transformer described is voluminous and costly, and the associated control circuits comprise a comparatively large number of components. The integration of the circuit into a compact discharge lamp (such as an "SL" lamp) is then difficult.

SUMMARY OF THE INVENTION

It is an object of the invention to provide a DC-AC converter obviating the drawbacks of the known converter while reducing the number of components required in the circuit to a minimum.

According to the invention a converter of the type described in the opening paragraph is therefore characterized in that the control circuit of the second switching element has a voltage measuring point which is connected to a rectifier element connected to the control circuit of the first switching element.

The control circuit of the second switching element functions as a main control circuit and the control circuit of the first switching element functions as an auxiliary control circuit. The instantaneous state of conductance of the second switching element is fixed in this auxiliary control circuit via the rectifier element. Based on the value of the voltage in the control circuit of the second switching element, the first switching element is brought to a conducting state which is opposed to that of the second switching element.

Only one induction coil is required in the converter according to the invention. The use of a voluminous and costly transformer in the converter (with special requirements being imposed on the electrical insulation between the primary and secondary windings) is obviated. In comparison with the known converter, the number of electrical components required in the circuit is reduced. In addition, integration of components (for example, with the help of a "surface mounted device" technique) becomes more practical. This renders the converter more suited for use in a compact discharge lamp to replace an incandescent lamp for general illumination purposes.

In a preferred embodiment, the rectifier element is connected to a central tap functioning as a voltage measuring point of an LC oscillatory circuit in the control circuit of the second semiconductor switching element. The coil of the LC circuit is magnetically decoupled from the induction coil, and the central tap is connected to the load circuit by means of the capacitor of the LC circuit.

The frequency at which the switching elements are rendered conducting can be adjusted exactly by means of the oscillatory circuit. In addition, this frequency is very stable.

In a practical embodiment of the converter according to the invention the control circuit of the first semiconductor switching element comprises a circuit connected to one input terminal for switching on the switching element, and a separate circuit for switching off said switching element. The latter circuit includes a third semiconductor switching element which is conducting during substantially the same periods as the second switching element.

The periods when the first switching element is non-conducting are determined by means of the third switching element. The use of the third semiconductor switching element has the advantage that the relevant control circuit does not require any extra inductive elements.

In a preferred embodiment the coil of the LC oscillatory circuit in the control circuit of the second switching element (in which the central tap of the circuit is connected to the rectifier element) is bridged by a variable impedance.

An advantage of this embodiment is that the lamp can be dimmed by increasing the frequency at which the circuit oscillates.

In the preferred embodiment the variable impedance comprises a series arrangement of a resistor and two oppositely arranged zener diodes also arranged in series. Together with a capacitor arranged between the lamp electrodes and the coil arranged in series with the lamp, the frequency of the LC oscillatory circuit is adjusted to a value near the resonance frequency of the oscillatory circuit constituted by the capacitor and the coil in series with the lamp. A high voltage for igniting the lamp is available by choosing an appropriate starting frequency.

DESCRIPTION OF THE PREFERRED EMBODIMENT

Figure 1:
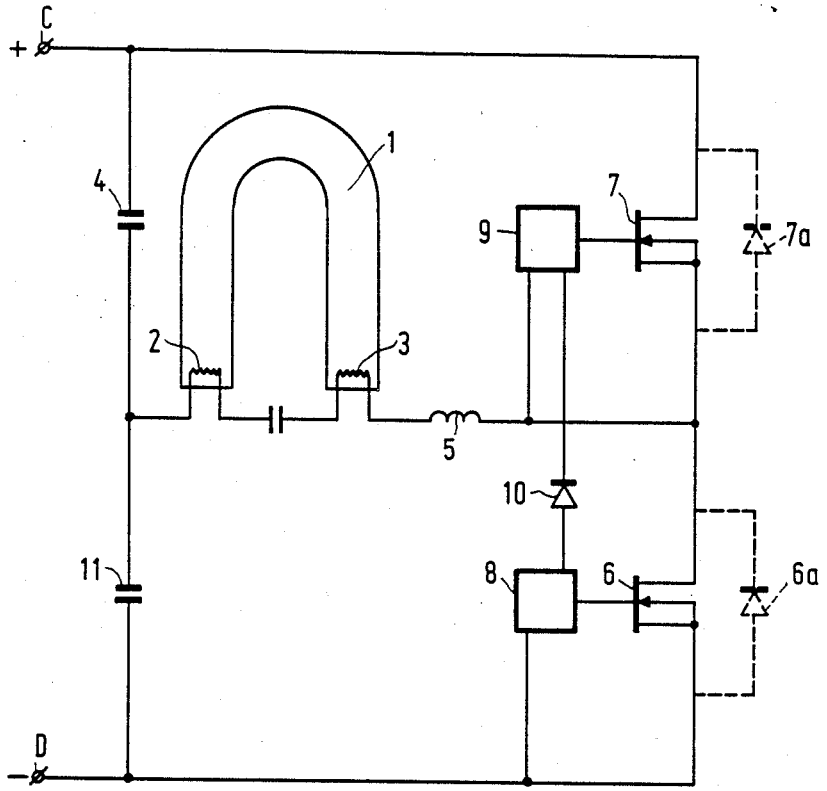
FIG. 1 shows diagrammatically the circuit of the converter according to the invention with a discharge lamp connected thereto.

In FIG. 1 the reference numeral 1 denotes a U-shaped low-pressure mercury vapour discharge lamp. In a practical embodiment the lamp has four parallel discharge tubes arranged in a square and interconnected by bridges (see U.S. Pat. No. 4,374,340). The lamp has two electrodes (2 and 3, respectively).

The references C and D denote the input terminals of the converter. These are intended to be connected to a DC voltage source such as a diode bridge with a smoothing capacitor (see FIG. 2).

The terminals C and D are interconnected by means of a series arrangement of a load circuit (comprising a capacitor 4, the lamp 1, and an induction coil 5) and a first semiconductor switching element 6 with an integrated freewheel diode (6*a*) which is shown in a broken lineform. The load circuit is bridged by (i.e. connected in parallel with) a circuit including a second semiconductor switching element 7 (with freewheel diode 7*a*). The two switching elements 6 and 7 are provided with control circuits 8 and 9 which are shown diagrammatically. With the aid of these control circuits the elements 6 and 7 are rendered alternately conducting and non-conducting. The control circuit 9 for the second switching element 7 has a voltage measuring point which is connected to the rectifier element (diode) 10, which element is connected to the control circuit 8 of the first switching element 6. The rectifier element 10 functions as a sensor for the voltage at the said measuring point. Furthermore electrode 2 is connected to input terminal D by capacitor 11.

The control circuit 9 functions as a main control circuit, whereas control circuit 8 functions as an auxiliary control circuit. The circuit 8 senses the instantaneous state of conductance of the switching element 7 via the rectifier element 10. Based on the value of the voltage in the control circuit of said switching element 7, the switching element 6 is brought to a state of conductance which is opposed to that of the switching element 7. This is realized in practice in the circuit according to FIG. 2.

Figure 2:
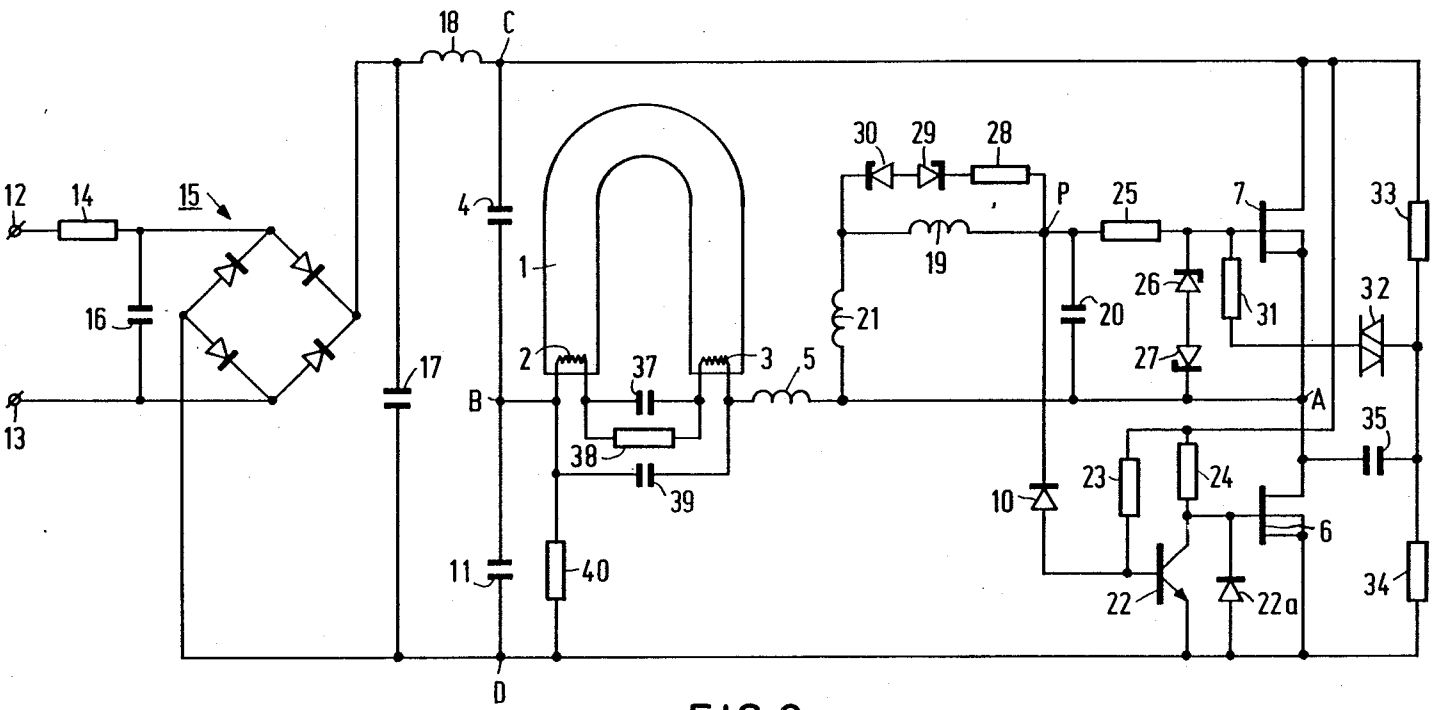
FIG. 2 shows an embodiment of the circuit of the converter according to the invention.

In FIG. 2, the same elements as those shown in FIG. 1 have identical reference numerals. The reference numerals 12 and 13 denote the input terminals to be connected to an AC voltage source (220 V, 50 Hz). The input terminal 12 is connected via a resistor 14 to an input terminal of a diode bridge 15. The two input terminals of the bridge are interconnected by means of the capacitor 16. The combination of the resistor 14 and the capacitor 16 constitutes an input filter. The output terminals of the bridge 15 are interconnected by means of the smoothing capacitor 17. Furthermore, a smoothing coil 18 is connected in series between one terminal of the bridge and a first input terminal C of the DC-AC converter. This converter is actually connected to the ends of the combination of capacitor 17 and coil 18. The converter is in the form of a half bridge converter. The first pair of legs of this half bridge converter is constituted by a series arrangement of two branches comprising a capacitor 4 and a capacitor 11, respectively. A second pair of legs is constituted by a series arrangement of two branches comprising semiconductor switching elements 6 and 7, respectively (with an integrated freewheel function, see FIG. 1).

The central branch of the converter is constituted by the connection of the point A (between transistors 6 and 7) and B point (between capacitors 11 and 4). The terminals C and D are interconnected via the load circuit already referred to in FIG. 1 (comprising the series arrangement of capacitor 4, lamp 1, coil 5) and switching element 6. This load circuit is bridged by a circuit including the second switching element 7.

The first switching element 6 is associated with a control circuit (8) comprising a circuit which is connected to the input terminal (D) for switching on element 6. A separate circuit is provided which is connected to the central tap of an LC oscillatory circuit comprising the coil 19 and the capacitor 20. The coil 19 is electrically connected to coil 5 via the auxiliary winding 21 on coil 5. The circuit comprises the rectifier element 10 which is connected to the base of the auxiliary transistor 22. The base of this transistor is also connected to terminal C via the resistor 23. The collector of transistor 22 is connected to the control electrode of switching element 6. Furthermore, the resistor 24 is connected between the collector of transistor 22 and the terminal C. The control circuit of the second switching element 7 includes a resistor 25 coupled between the control electrode of element 7 and the central tap P of the LC oscillatory circuit (19 and 20). Furthermore, a circuit consisting of two oppositely arranged zener diodes 26 and 27 is present between point A and the control electrode of semiconductor switching element 7. Transistor 22 is also bridged by a zener diode 22*a*.

The coil 19 is bridged by a series arrangement of a resistor 28 and two oppositely arranged zener diodes 29 and 30. The converter is also provided with a starter circuit comprising a series arrangement of a resistor 31 and a bidirectional breakdown element (diac) 32 coupled between the control electrode of element 7 and a junction point of the resistors 33 and 34. A capacitor 35 is also connected between the said junction point and point A. The first ends of the electrodes 2 and 3 of the lamp are interconnected by means of a capacitor 39. The other ends are interconnected by means of a parallel arrangement of resistor 38 having a positive temperature coefficient (PTC) and capacitor 37. Resistor 40 is arranged in parallel with capacitor 11.

The converter operates as follows. If the terminals 12 and 13 are connected to the AC supply mains (e.g. 220 V, 50 Hz), the capacitor 17 will be charged via the diode bridge 15. This results in the capacitors 4 and 11 also being charged via coil 18. The starting capacitor 35 will also be charged via the circuit 18, 33, 34 and A, D. When the voltage at the capacitor 35 reaches the threshold voltage of circuit element 32, said element 32 will begin to conduct and it will render the semiconductor switch 7 conductive via circuit element 31. The electrodes 2 and 3 of the lamp are then preheated (by means of the PTC resistor 38, as described in U.S. Pat. No. 4,647,820).

The control signal for rendering switching element 6 conducting is directly supplied by the voltage of the capacitors 4 and 11. An AC voltage at a frequency which is very accurately determined by coil 19 and capacitor 20 (the LC oscillatory circuit) is produced across capacitor 20 between the points P and A. The said voltage is responsible for switching off element 7. Switching element 7 is switched off while a current is still flowing through coil 5, and causes a freewheel current to flow through element 6. Consequently, point A acquires the same potential as point D. If the voltage at point P becomes negative with respect to point A, the control current of the auxiliary transistor 22 is diverted through rectifier element 10 and transistor 22 is turned off. However, as soon as the voltage difference between points P and A is zero again, the auxiliary transistor 22 is turned on and element 6 becomes non-conductive. Then switching element 7 becomes conducting again, etc. Thus the voltage is measured in the control circuit 9 of switching element 7 and this measured voltage determines when the element 6 is rendered conducting.

For igniting the lamp the frequency of the oscillatory circuit can be adjusted by means of the elements 28, 29 and 30.

In one embodiment the most essential circuit elements had the following values:

| | |
|---|---|
| capacitor 4 | 220 nF |
| capacitor 11 | 220 nF |
| capacitor 17 | 11 μF |
| capacitor 20 | 10 nF |
| capacitor 35 | 22 nF |
| coil 5 | 3 mHenry |
| coil 19 | 680 μHenry |
| ratio of turns of coil 5:coil 21 = 220:7 turns | |
| MOS-FET 6 | type BST 78 |
| MOS-FET 7 | type BST 78 |
| transistor 22 | type BC 547 |
| frequency LC circuit: | 28 kHz. |

In this embodiment the lamp 1 ignited at a voltage of 600 V between the electrodes 2 and 3. The lamp is of the type having four interconnected discharge tubes arranged in a square (see, for example, U.S. Pat. No. 4,777,405 (10/11/88). The lamp efficiency was approximately 60 lm/Watt.

What is claimed is:

1. A DC-AC converter for igniting and supplying a gas discharge lamp comprising; two input terminals for connection to a DC voltage source, said input terminals being interconnected by means of a series arrangement including a load circuit comprising at least the discharge lamp and an induction coil, and a first semiconductor switching element including a freewheel diode, said load circuit being bridged by a circuit including a semiconductor switching element also having a freewheel diode, said semiconductor switching elements being coupled to respective control circuits for rendering said switching elements alternately conducting, wherein the control circuit of the second switching element has a voltage measuring point connected via a rectifier element to the control circuit of the first switching element such that a voltage developed at said voltage measuring point determines the time at which the first semiconductor switching element is made to conduct.

2. A DC-AC converter for igniting and supplying a gas discharge lamp comprising; two input terminals for connection to a DC voltage source, said input terminals being interconnected by means of a series arrangement including a load circuit comprising at least the discharge lamp and an induction coil, and a first semiconductor switching element including a freewheel diode, said load circuit being bridged by a circuit including a second semiconductor switching element also having a freewheel diode, said semiconductor switching elements being coupled to respective control circuits for rendering said switching elements alternately conducting, wherein the control circuit of the second switching element has a voltage measuring point connected via a rectifier element to the control circuit of the first switching element, and further comprising an LC oscillatory circuit in the control circuit of the second semiconductor switching element, said rectifier element being connected to a tap of the LC oscillatory circuit which functions as the voltage measuring point, a coil (L) of the LC circuit being magnetically decoupled from the induction coil, and said tap being connected to the load circuit by means of a capacitor (C) of the LC circuit.

3. A DC-AC converter as claimed in claim 2, characterized in that the control circuit of the first semiconductor switching element comprises a circuit connected to one input terminal for switching on the first switching element, and a separate circuit for switching off said first switching element, said separate circuit including a third semiconductor switching element which is conductive during substantially the same time periods as the second switching element.

4. A DC-AC converter as claimed in claim 3, characterized in that the coil of the LC oscillatory circuit is bridged by a variable impedance.

5. A DC-AC converter as claimed in claim 4, characterized in that the variable impedance comprises a series arrangement of a resistor and two oppositely arranged zener diodes.

6. A DC-AC converter for igniting and supplying a gas discharge lamp comprising; two input terminals for connection to a DC voltage source, said input terminals being interconnected by means of a series arrangement including a load circuit comprising at least the discharge lamp and an induction coil, and a first semiconductor switching element including a freewheel diode, said load circuit being bridged by a circuit including a second semiconductor switching element also having a freewheel diode, said semiconductor switching elements being coupled to respective control circuits for rendering said switching elements alternately conducting, wherein the control circuit of the second switching element has a voltage measuring point connected via a rectifier element to the control circuit of the first switching element and the control circuit of the first semiconductor switching element comprises a circuit connected to one input terminal for switching on the first switching element, and a separate circuit for switching off said first switching element, said separate circuit including a third semiconductor switching element which is conductive during substantially the same time periods as the second switching element.

7. A DC-AC converter as claimed in claim 2, characterized in that the coil of the LC oscillatory circuit is bridged by a variable impedance.

8. A DC-AC converter as claimed in claim 7, wherein the variable impedance controls the frequency of the LC oscillatory circuit thereby to control the light output of a discharge lamp as a function of said frequency.

9. A DC/AC converter for connection to a load that includes a discharge lamp, said converter comprising:

first and second input terminals for a source of DC voltage, means connecting first and second controlled semiconductor switching elements, each of which includes a freewheel diode, in a first series circuit across said input terminals and with a first junction point therebetween, means connecting first and second impedance elements in a second series circuit across said input terminals and with a second junction point therebetween, means coupling said load and an inductor in a series arrangement between said first and second junction points, which series arrangement is devoid of any transformer windings, first and second control circuits coupled to respective control electrodes of said first and second semiconductor switching elements, respectively, for alternately driving said semiconductor switching elements into conduction, wherein the second control circuit includes a circuit point at which a varying voltage is developed which is indicative of the on/off state of the second semiconductor switching element, and a rectifier element coupled between said circuit point and a control input of the first control circuit so that said varying voltage controls the switching point of the first semiconductor switching element.

10. A DC/AC converter as claimed in claim 9 wherein said first and second control circuits are asymmetrical as to circuit configuration and circuit components.

11. A DC/AC converter as claimed in claim 9 wherein the second control circuit comprises an LC circuit which includes said circuit point.

12. A DC/AC converter as claimed in claim 11 wherein the LC circuit includes a capacitor (C) coupling said circuit point to a further circuit point of said series arrangement.

13. A DC/AC converter as claimed in claim 11 further comprising a variable impedance connected in parallel with an inductor (L) of said LC circuit.

14. A DC/AC converter as claimed in claim 9 wherein the first control circuit includes a control transistor coupled between the control electrode and one main electrode of the first semiconductor switching element and with a control terminal thereof coupled to said control input of the first control circuit.

* * * * *